US008912903B1

(12) United States Patent
Dounis

(10) Patent No.: US 8,912,903 B1
(45) Date of Patent: Dec. 16, 2014

(54) DOOR KNOB SECURITY ALARM

(71) Applicant: Dimitros Dounis, Toms River, NJ (US)

(72) Inventor: Dimitros Dounis, Toms River, NJ (US)

( * ) Notice: Subject to any disclaimer, the term of this patent is extended or adjusted under 35 U.S.C. 154(b) by 169 days.

(21) Appl. No.: 13/669,556

(22) Filed: Nov. 6, 2012

(51) Int. Cl.
*G08B 13/08* (2006.01)

(52) U.S. Cl.
USPC ..... 340/546; 340/541; 340/545.2; 340/545.7; 292/338; 292/339

(58) Field of Classification Search
USPC ..... 340/541, 545.2, 545.6, 545.7, 545.8, 340/546, 547.7, 549; 200/61.39, 61.48, 200/61.52, 61.93; 292/338, 339
See application file for complete search history.

(56) References Cited

U.S. PATENT DOCUMENTS

| | | | | |
|---|---|---|---|---|
| D94,600 | S | 2/1935 | Dunkelberger | |
| 3,725,892 | A * | 4/1973 | Faltico | 340/541 |
| 4,100,539 | A | 7/1978 | Stahl et al. | |
| 4,339,747 | A * | 7/1982 | Maybee | 340/547 |
| 4,809,320 | A * | 2/1989 | Hawkins et al. | 379/167.05 |
| D359,251 | S | 6/1995 | Tallent | |
| 5,712,623 | A | 1/1998 | Kumai et al. | |
| 6,154,130 | A | 11/2000 | Mondejar et al. | |
| 6,690,288 | B1 | 2/2004 | Waddell | |
| 6,831,559 | B2 | 12/2004 | Chen | |
| 2011/0254689 | A1 * | 10/2011 | Snyder | 340/545.5 |

* cited by examiner

*Primary Examiner* — Hung T Nguyen
(74) *Attorney, Agent, or Firm* — Kyle A. Fletcher, Esq.

(57) ABSTRACT

The door knob security alarm is a door alarm that is uniquely adapted to rest upon a top half of a door knob, and upon movement of the door knob the security alarm shell fall off of the door knob, and emit an alarm upon impacting the ground. An alarm housing includes a concave portion along a bottom portion of said alarm housing, which is uniquely adapted for placement atop of a portion of a door handle or door knob. A motion sensor detects impact of the alarm housing with a ground surface, and shall generate an alarm that is audible. The security alarm includes the use of at least one speaker that emits an audible alarm. The alarm housing includes at least one switch on a top surface, which enables operation of the security alarm.

20 Claims, 4 Drawing Sheets

DOOR KNOB SECURITY ALARM

CROSS REFERENCE TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of security alarms, more specifically, a security alarm that rests atop of a door handle, and which is able to slide off upon rotation of said door knob thereby falling to the ground, and activating said security alarm.

Door knob-related security alarms provide a direct line of detecting motion of a door. However, these alarms are bulky or do not provide the simplicity associated with an object that rests on a top half of a door handle or knob, and which is able to slide off when the handle or knob is rotated or attempted to be rotated.

The device of the present application addresses the needs for a simplistic door knob alarm by providing housing uniquely adapted to sit on a top half of the handle or knob, and which is able to slide off when the handle or knob is rotated or attempted to be rotated. Moreover, the housing includes a motion sensor that signals an alarm upon impact of the housing with the ground surface after falling off of the handle or knob.

B. Discussion of the Prior Art

As will be discussed immediately below, no prior art discloses a door knob security alarm that is uniquely adapted for use with a top half of a door handle or knob in order to detect movement of the door handle or knob, and which then signals an alarm; wherein an alarm housing includes a concave portion along a bottom portion of said alarm housing, which is uniquely adapted for placement atop of a portion of a door handle or knob; where upon rotating of said door handle or knob, the door knob security alarm is able to slide off of said door handle or knob, and upon impacting a ground surface shall generate a security alarm via a motion sensor; wherein the security alarm includes the use of at least one speaker that emits an audible alarm; wherein the alarm housing includes at least one switch on a top surface, which enables operation of the security alarm.

The Chen Patent (U.S. Pat. No. 6,831,559) discloses a security alarm hung from a doorknob. However, the security alarm does not rest onto a top portion of a door knob, and rely on a motion of the door knob to knock off the alarm, and then activate said alarm.

The Mondejar et al. Patent (U.S. Pat. No. 6,154,130) discloses a portable room security system having a hook to be suspended from a door knob. Again, the security system relies upon being suspended from a door knob as opposed to resting atop of a top half portion of said door knob.

The Waddell Patent (U.S. Pat. No. 6,630,288) discloses an emergency response system that hangs from a doorknob. However, the security system is unable to fall off of the top half of a door knob.

The Kumai et al. Patent (U.S. Pat. No. 5,712,623) discloses an alarm hung from a doorknob. However, the alarm does not fall from a door knob when the door knob is rotated, and thereafter generate an audible alarm upon impact with the ground surface.

The Stahl et al. Patent (U.S. Pat. No. 4,100,539) discloses a burglar alarm adapted to slide over a door knob. However, the alarm is not a housing uniquely adapted to rest or sit atop of a top half of a door knob or handle, and which falls off upon rotation or attempted rotation of the door knob or handle.

The Tallent Patent (U.S. Pat. No. Des. 359,251) illustrates a design for a portable door knob alarm, which includes a hole into which the door knob is inserted, and is not resting atop of the door knob.

While the above-described devices fulfill their respective and particular objects and requirements, they do not describe a door knob security alarm that is uniquely adapted for use with a top half of a door handle in order to detect movement of the door handle, and which then signals an alarm; wherein an alarm housing includes a concave portion alone; a bottom portion of said alarm housing, which is uniquely adapted for placement atop of a portion of a door handle; where upon rotating of said door knob, the door knob security alarm is able to slide off of said door knob, and upon impacting a ground surface shall generate a security alarm via a motion sensor; wherein the security alarm includes the use of at least one speaker that emits an audible alarm; wherein the alarm housing includes at least one switch on a top surface, which enables operation of the security alarm. In this regard, the door knob security alarm departs from the conventional concepts and designs of the prior art.

SUMMARY OF THE INVENTION

The door knob security alarm is a door alarm that is uniquely adapted to rest upon a top half of a door knob, and upon movement of the door knob the security alarm shall fall off of the door knob, and emit an alarm upon impacting the ground. An alarm housing includes a concave portion along a bottom portion of said alarm housing, which is uniquely adapted for placement atop of a portion of a door handle or door knob. A motion sensor detects impact of the alarm housing with a ground surface, and shall generate an alarm that is audible. The security alarm includes the use of at least one speaker that emits an audible alarm. The alarm housing includes at least one switch on a top surface, which enables operation of the security alarm.

It is an object of the invention to provide a door knob security alarm that relies upon resting the alarm housing on a top half of a door knob, and which falls off of said door knob upon rotating the door knob.

A further object of the invention is to provide an alarm housing that relies upon a concave portion on a bottom portion of the alarm housing in order to sit or rest on a top portion of the door knob, and which is able to slide off of the door knob when the door knob is rotated or attempted to be rotated.

A further object of the invention is to provide a motion sensor that is uniquely adapted to detect the force associated with the alarm housing falling from the door knob and impacting the ground surface.

A further object of the invention is to provide a speaker and switches that provide an audible alarm and means for control of the alarm.

These together with additional objects, features and advantages of the door knob security alarm will be readily apparent to those of ordinary skill in the art upon reading the following detailed description of presently preferred, but nonetheless illustrative, embodiments of the door knob security alarm when taken in conjunction with the accompanying drawings.

In this respect, before explaining the current embodiments of the door knob security alarm in detail, it is to be understood that the door knob security alarm is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the door knob security alarm.

It is therefore important that the claims be regarded as including such equivalent construction insofar as they do not depart from the spirit and scope of the door knob security alarm. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 3 illustrates a front view of the door knob security alarm in working use upon rotation of the door knob, the alarm falls off of said door knob, and upon impacting the ground an alarm is emitted there from.

DETAILED DESCRIPTION OF THE EMBODIMENT

Figure 1:
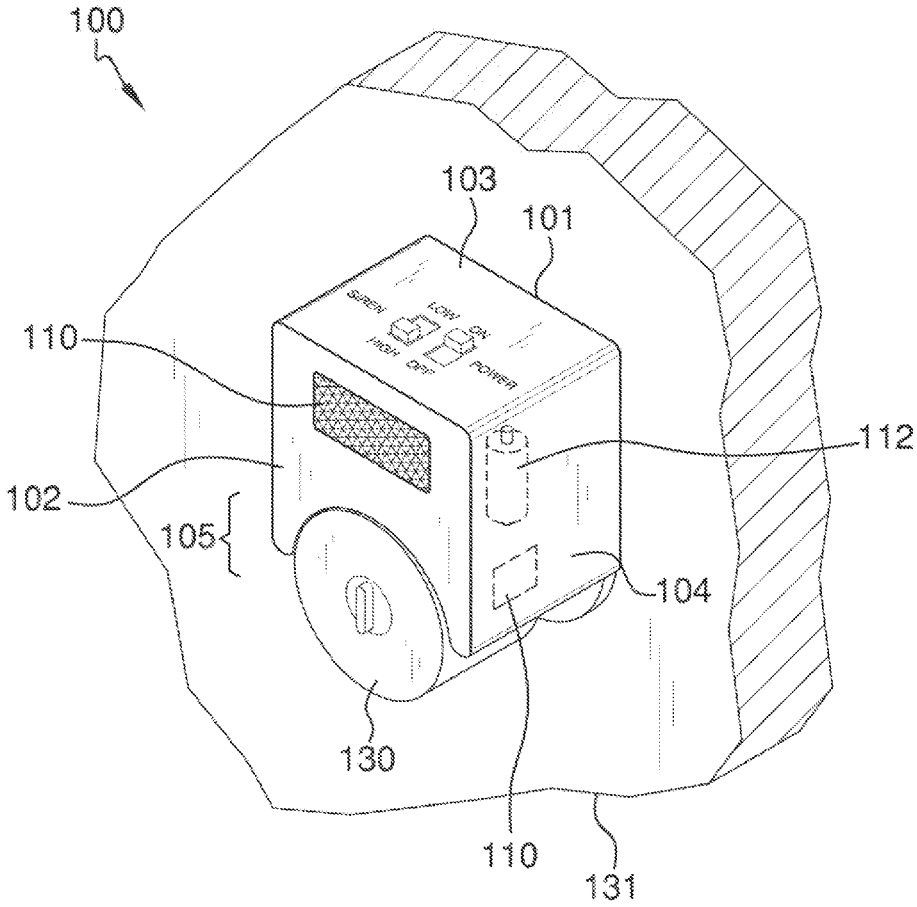
FIG. 1 illustrates a front perspective view of the door knob security alarm positioned onto a top portion of a door knob, and ready for use, and further detailing a motion sensor member in broken lines.
Figure 2:
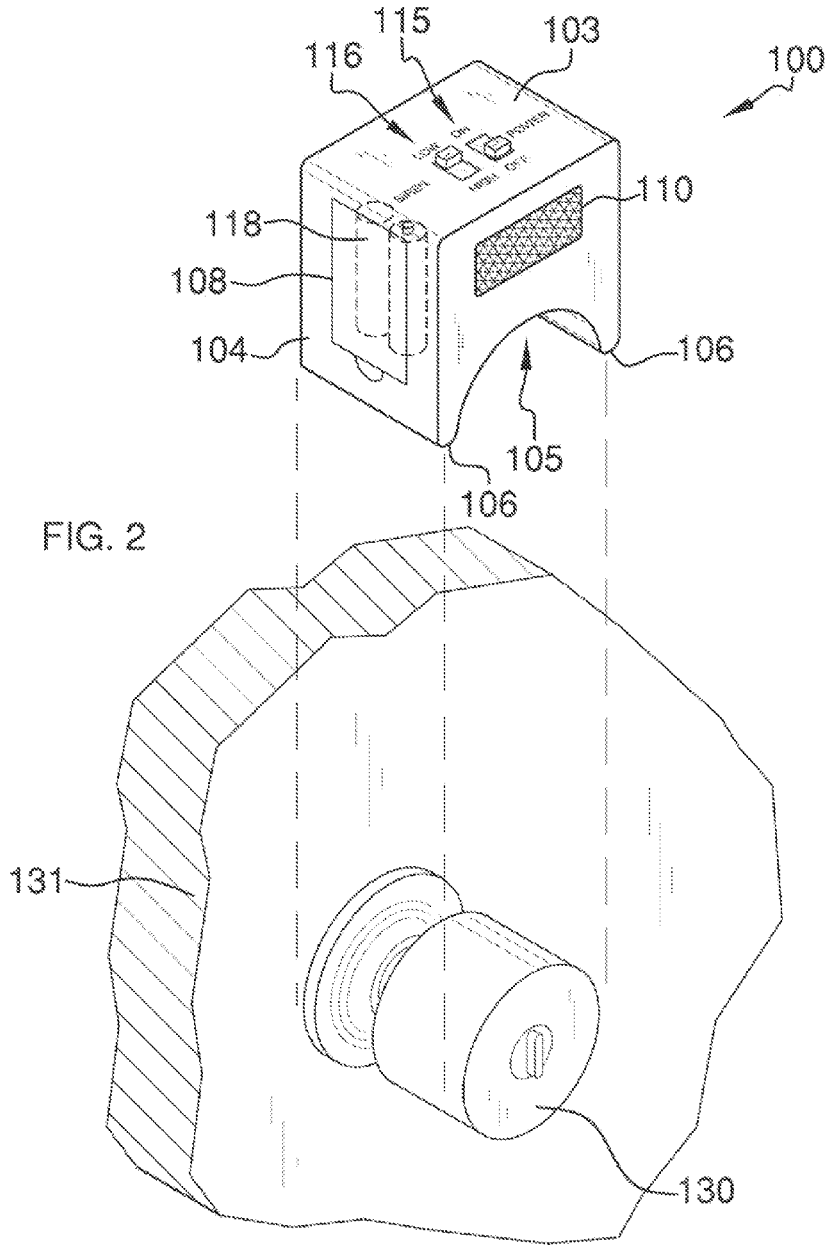
FIG. 2 illustrates a front perspective view of the door knob security alarm aligned atop of a door knob, and further depicting the powering member in broken lines located inside of a battery compartment.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4. A door knob security alarm 100 (hereinafter invention) includes an alarm housing 101 of hollowed construction, and further defined with a front surface 102, a top surface 103, side surfaces 104, and a concave portion 105. The concave portion 105 consumes a bottom half of the alarm housing 101, and is specifically adapted to rest atop of a door knob 130. It shall be noted that the term door knob 130 is being used to refer to door handles and other hardware associated with opening a closed door 131.

The concave portion 105 includes a curvature that mimics the door knob 130. The concave portion 105 as essentially a cylindrical recess that has a smoothed surface, which enables the invention 100 to slide off of the door knob 130 upon rotating or attempting to rotate the door knob 130. It shall be further noted that the concave portion 105 is designed to straddle as well as sit atop of the door knob 130. Thus, the bottom portion 105 has corners 106 that stop at the 3 and 9 o'clock positions of the door knob 130.

The alarm housing 101 houses all of the components of the invention 100. The alarm housing 101 includes a speaker 110 that may be located on the front surface 102, and which provides an audible alarm when signaled via a central processing unit 111 (hereinafter CPU). The CPU 111 is in wired communication with the speaker 110, a motion sensor 112, and switches 113. The motion sensor 112 is located inside of the alarm housing 101, and is included to detect motion and impact with a ground surface 140 that is attributed with the invention 100 falling from the door knob 130.

The motion sensor 112 is configured to detect the impact associated with falling from the door knob 130, and generating a signal to the CPU 111 in order to generate the applicable alarm via the speaker 110. The switches 113 may be located on the top surface 103 of the alarm housing 101. The switches 113 may include an on/off switch 115 and a low/high switch 116. The on/off switch 115 is responsible for powering on or off the invention 100 whereas the low/high switch 116 is responsible for controlling the volume of noise generated via the speaker 110. The switches 113 are wired to the CPU 111, which is also in wired communication with a powering member 118. The powering member 118 is further defined with at least one battery that is housed within a battery compartment 108.

The battery compartment 108 is accessible on one of the side surfaces 104 of the alarm housing 101. The battery compartment 108 enables the powering member 118 to be replaced or recharged as needed.

Figure 4:
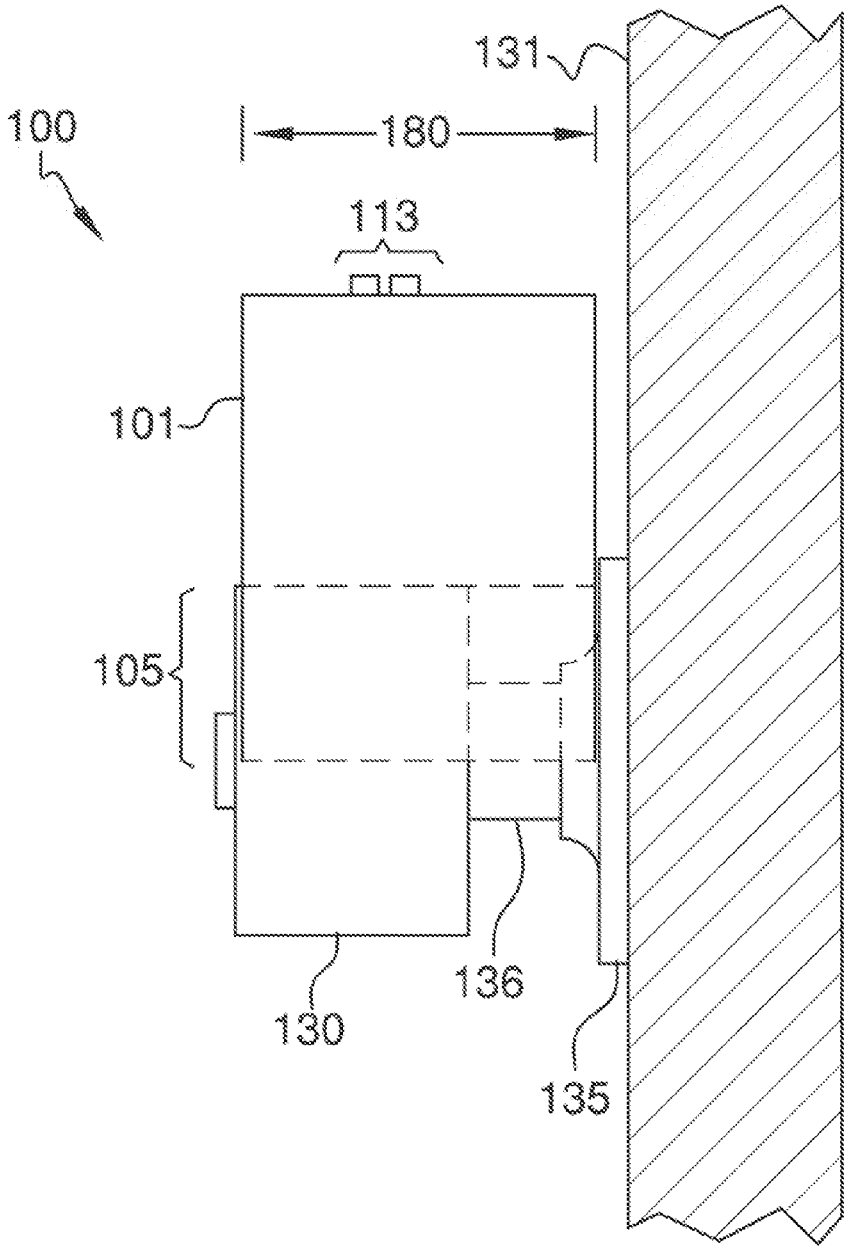
FIG. 4 illustrates a side view of the door knob security alarm placed atop of the top half of the door knob, and depicting the concave portion seated onto the door knob.

Referring to FIG. 4, the alarm housing 101 has a width 180, which is designed to enable the concave portion 105 to not only sit atop of the door knob 130 but also to span rearwardly in order to impact or rest against a handle collar 135. The handle collar 135 is the portion of the door knob 130 that rests against the surface of the door 131. It shall be further noted that the alarm housing 101 spans across a neck portion 136 that exists between the door knob 130 and the handle collar 135.

Figure 3:
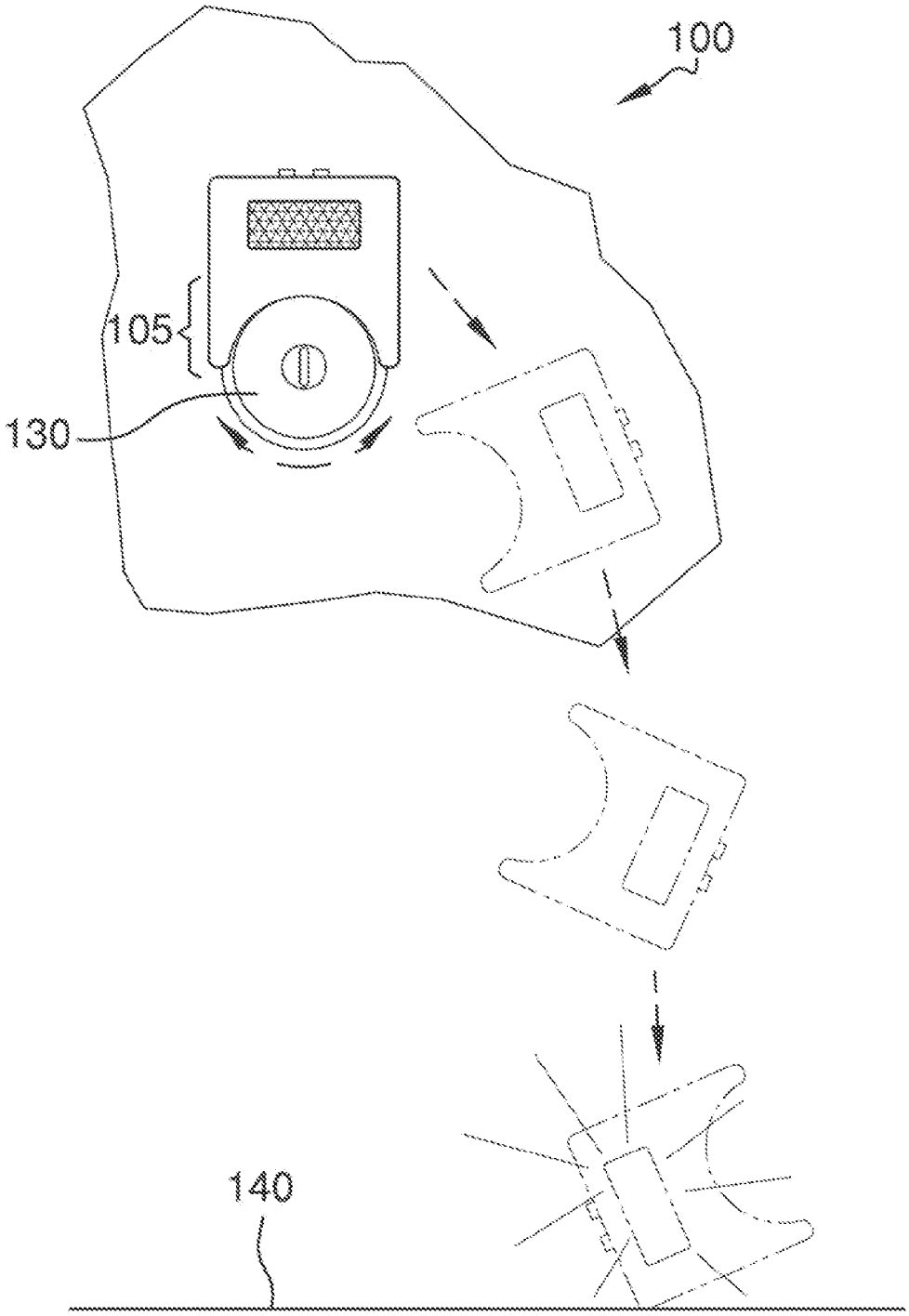

Referring to FIG. 3, the invention 100 is specifically adapted to fall from the door knob 130 when either rotated or attempted to be rotated as is the case when the door knob 130 is locked. The alarm housing 101 shall fall from the door knob 130 by rolling to either side of the door knob 130 as is depicted in FIG. 3. It shall be noted that the alarm feature of the invention 100 does not commence until the motion sensor 112 detects the force associated with the alarm housing 101 impacting the ground surface 140.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A door knob security alarm comprising:

an alarm housing specifically adapted to sit atop of an existing door knob such that when said door knob is either rotated or attempted to be rotated, said alarm housing shall fall from said door knob, and upon impact with a ground surface said alarm housing shall generate an audible alarm indicating that said door knob has been impacted.

2. The door knob security alarm as described in claim 1 wherein the alarm housing is of hollowed construction, and further defined with a front surface, a top surface, side surfaces, and a concave portion.

3. The door knob security alarm as described in claim 2 wherein the concave portion encompasses a bottom half of the alarm housing, and is specifically adapted to rest atop of the door knob.

4. The door knob security alarm as described in claim 3 wherein the concave portion includes a curvature that mimics the door knob; wherein the concave portion is designed to straddle as well as sit atop of the door knob.

5. The door knob security alarm as described in claim 4 wherein the bottom portion has corners that stop at the 3 and 9 o'clock positions of the door knob.

6. The door knob security alarm as described in claim 5 wherein the alarm housing includes a speaker, which is in wired communication with a central processing unit.

7. The door knob security alarm as described in claim 6 wherein the speaker is located on the front surface of the alarm housing.

8. The door knob security alarm as described in claim 6 wherein the central processing unit is also in wired communication with a motion sensor, switches, and a powering member.

9. The door knob security alarm as described in claim 8 wherein the motion sensor, along with the central processing unit, is located inside of the alarm housing, and is included to detect motion and impact with the ground surface that is attributed with the alarm housing falling from the door knob.

10. The door knob security alarm as described in claim 9 wherein the switches are located on the top surface of the alarm housing.

11. The door knob security alarm as described in claim 10 wherein the switches are further defined with an on/off switch and a low/high switch; wherein the on/off switch is responsible for powering on or off the door knob security alarm whereas the low/high switch is responsible for controlling the volume of noise generated via the speaker.

12. The door knob security alarm as described in claim 11 wherein the powering member is further defined with at least one battery that is housed within a battery compartment; wherein the battery compartment is accessible on one of the side surfaces of the alarm housing.

13. The door knob security alarm as described in claim 12 wherein the alarm housing has a width whereby the concave portion sits atop of the door knob, and also spans rearwardly in order to impact or rest against a handle collar; wherein the alarm housing spans across a neck portion that exists between the door knob and the handle collar.

14. A door knob security alarm comprising:

an alarm housing specifically adapted to sit atop of an existing door knob such that when said door knob is either rotated or attempted to be rotated, said alarm housing shall fall from said door knob, and upon impact with a ground surface said alarm housing shall generate an audible alarm indicating that said door knob has been impacted;

wherein the alarm housing is of hollowed construction, and further defined with a front surface, a top surface, side surfaces, and a concave portion;

wherein the concave portion encompasses a bottom half of the alarm housing, and is specifically adapted to rest atop of the door knob;

wherein the concave portion includes a curvature that mimics the door knob; wherein the concave portion is designed to straddle as well as sit atop of the door knob;

wherein the bottom portion has corners that stop at the 3 and 9 o'clock positions of the door knob;

wherein the alarm housing has a width whereby the concave portion sits atop of the door knob, and also spans rearwardly in order to impact or rest against a handle collar; wherein the alarm housing spans across a neck portion that exists between the door knob and the handle collar.

15. The door knob security alarm as described in claim 14 wherein the alarm housing includes a speaker, which is in wired communication with a central processing unit; wherein the speaker is located on the front surface of the alarm housing.

16. The door knob security alarm as described in claim 15 wherein the central processing unit is also in wired communication with a motion sensor, switches, and a powering member.

17. The door knob security alarm as described in claim 16 wherein the motion sensor, along with the central processing unit, is located inside of the alarm housing, and is included to detect motion and impact with the ground surface that is attributed with the alarm housing falling from the door knob.

18. The door knob security alarm as described in claim 17 wherein the switches are located on the top surface of the alarm housing.

19. The door knob security alarm as described in claim 18 wherein the switches are further defined with an on/off switch and a low/high switch; wherein the on/off switch is responsible for powering on or off the door knob security alarm whereas the low/high switch is responsible for controlling the volume of noise generated via the speaker.

20. The door knob security alarm as described in claim 19 wherein the powering member is further defined with at least one battery that is housed within a battery compartment; wherein the battery compartment is accessible on one of the side surfaces of the alarm housing.

* * * * *